United States Patent [19]

Ensing

[11] 4,241,161

[45] Dec. 23, 1980

[54] PROCESS FOR TRANSFERRING A MAGNETIZABLE DEVELOPING POWDER IN ELECTROSTATIC IMAGE DEVELOPMENT

[75] Inventor: Hendrik Ensing, Velden, Netherlands

[73] Assignee: Oce-Nederland B.V., Venlo, Netherlands

[21] Appl. No.: 81,005

[22] Filed: Oct. 1, 1979

[30] Foreign Application Priority Data

Oct. 4, 1978 [NL] Netherlands ..... 7810011

[51] Int. Cl.[3] ..... B05D 1/06

[52] U.S. Cl. ..... 430/126; 430/122; 430/902; 355/3 TR; 118/657

[58] Field of Search ..... 430/126, 122, 103, 48, 430/902, 49; 118/657, 658; 355/3 TR

[56] References Cited

U.S. PATENT DOCUMENTS

| | | | |
|---|---|---|---|
| 3,675,011 | 7/1972 | Silverberg | 250/49.52 C |
| 4,122,210 | 10/1978 | Gundlac h | 430/126 |

FOREIGN PATENT DOCUMENTS 2547118 4/1977 Fed. Rep. of Germany .

OTHER PUBLICATIONS

Xerox Disclosure J., vol. 2, No. 1, Jan.-Feb.'77, pp. 59-60.

*Primary Examiner*—John D. Welsh

*Attorney, Agent, or Firm*—Albert C. Johnston; Alphonse R. Noë

[57] ABSTRACT

An improved process for transferring a magnetizable developing powder from an insulating substitute, such as an electrostatic duplication master or photoconductive element to a receiving material, such as paper, in electrostatic image development enables the transfer of powder having a specific resistance greater than $10^{13}$ Ohm.cm. without the need for specially treated paper. The powder is applied imagewise, corresponding to a charge image, on an insulating substrate, the substrate with the powder image brought in contact with the receiving material to which the powder is to be transferred, two separate charges are applied to the free side of the receiving material during the period of contact with the substrate, the first of such charges, a pre-transfer charge, having a polarity opposite to that of the charge image and the second of such charges, a transfer charge, being greater than the first and having the same polarity as that of the charge image, and the powder transferred. Advantageously, the first charge is between 0.08 to 0.17 $\mu$C per cm$^2$., the second charge is at least 0.5 $\mu$C per cm$^2$. and the charges are applied within 0.5 second after each other. Transfer yields of 85 percent may be obtained and the receiving material may be ordinary paper with a surface resistance between $5\times10^9$ to $10^{11}$ Ohm per square.

7 Claims, 4 Drawing Figures

PROCESS FOR TRANSFERRING A MAGNETIZABLE DEVELOPING POWDER IN ELECTROSTATIC IMAGE DEVELOPMENT

This invention relates generally to the development of electrostatic images. More specifically, this invention relates to a process for transferring a magnetizable developing powder, having a specific resistance greater than $10^{13}$ Ohm.cm., from an insulating substrate to a receiving material. The powder is first applied imagewise, corresponding to a charge image, on the insulating substrate. In the transfer process the substrate with the powder image is brought in contact with the receiving material to which the powder is to be transferred, a charge is applied, during the contact, to the free side of the receiving material, that is, that side not in contact with the substrate, the powder is transferred and the receiving material is subsequently separated from the substrate.

A process of the above type is disclosed in German Auslegeschrift No. 2,547,118, describing a process in which a charge image on a photoconductive element is developed with a magnetic brush, the brush hairs of which are formed by a one-component magnetizable developing powder having a specific resistance of at least $10^{13}$ Ohm.cm. The powder image obtained is transferred to a sheet of paper by bringing the sheet in contact with the powder image and by applying a charge of the same polarity as the charge image on the photoconductive element to the free side of the sheet of paper by means of a corona charging element. Subsequently the paper is again separated from the photoconductive element.

The process described above has the disadvantage that sufficient developing powder is transferred to the paper only when the paper has a surface resistance of at least $10^{12}$ Ohm per square. Such a resistance value is generally reached in ordinary paper only when it has been conditioned at a relative humidity of about 25 percent or lower. Although it is known to increase the surface resistance of paper by the application of an insulating plastic layer on the paper, this results in the introduction of a new disadvantage in that the user is then forced to use special papers and can no longer copy on all kinds of paper, such as preprinted letter paper which generally has had no insulating layer applied to it.

An object of this invention is the provision of a process by which powder images of the type described above can be transferred, under varying conditions, with a good yield without adding new disadvantages to the system. This is achieved according to the invention through an improvement in the process for transferring magnetizable developing powder described above. The improvement comprises applying a first charge of 0.08 to 0.17 $\mu$C per cm.$^2$ having a polarity opposite to that of the charge image on the substrate to the free side of the receiving material during the contact of the substrate with the receiving material and subsequently applying a second charge of at least 0.5 $\mu$C per cm.$^2$ having the same polarity as that of the charge image, also during the contact period.

An optimum transfer yield is obtained when, during the contact of the receiving material with the powder image on the substrate, a first charge between 0.1 and 0.15 $\mu$C per cm.$^2$ and a second charge between 0.6 and 1.6 $\mu$C per cm.$^2$ are applied. Since the transfer yield decreases with increase in the time duration between the supply of the first and second charge, each location on the receiving material is preferably exposed to the second charge within 0.5 seconds after application of the first charge. Under optimum conditions a transfer yield of 85 percent is reached on paper with a surface resistance of $10^9$ Ohm per square. This means that even at a relative humidity of 60 percent in the copying apparatus the transfer yield is still amply sufficient.

The charges can be applied to the receiving material with the aid of known means. For example, such means may comprise two rolls with a metal core and a coating. A coating of conductive rubber having a specific resistance between $10^7$ and $10^9$ Ohm.cm. is very suitable. These rolls can also function to bring the receiving material into contact with the substrate. Alternatively, the means for applying the charges to the receiving material may comprise two corona discharge elements such as wires. In this case the receiving material is brought into contact with the substrate by means of auxiliary rolls. The means for applying the charges are preferably located as close to each other as possible, although generally a center distance between rolls or corona wires which is less than 2 to 3 cm. is not possible in connection with the minimum dimensions of those means. Generally a distance of 2 to 3 cm. is amply sufficient. For example, in a copying apparatus with a low copying speed which can produce 15 size A4 copies per minute, the speed with which the image-carrying substrate travels past the powder transfer station is about 5 meters per minute. With a center distance of 3 cm. between corona elements or rolls such a distance is covered within 0.4 seconds.

At a copying speed of 5 meters per minute and a working width of 21 cm., the current over the first corona element or roll, referred to as the pre-transfer current, must be set at a value between 15 and 22 $\mu$A for the application of the optimum first charge of 0.1 to 0.15 $\mu$C per cm$^2$. The second roll or corona element must supply a current, referred to as the transfer current, between 100 and 250 $\mu$A for applying the preferred charge of 0.6 to 1.6 $\mu$C per cm$^2$. The potentials required for these currents are dependent on the resistances and contact-resistances between the various materials. The influence of the paper resistance is low as a result of its relatively low resistance value.

When utilizing corona elements to apply the charges, the required potential on the first corona element generally lies at about 4 kV and that on the second corona element at about 7 kV, the polarities being, respectively, opposite to and the same as that of the charge image on the substrate. When utilizing contact rolls to apply the charges, for example, rolls with a 3 mm. thick rubber layer having a specific resistance of about $5\times10^8$ Ohm.cm. and used at a copying speed of 5 meters per minute, the potential on the first roll must be set at a value between 700 and 1,500 V, and the potential on the second roll at a value of about 4 kV. The rubber layer on the rolls functions as a buffer resistance. The thickness of the rubber layer can be halved without any objection in which case the potentials required will become considerably lower. When increasing the copying speed, generally the potential on the rolls or corona elements must also be increased.

The use of the magnetizable powder transfer process according to this invention is not limited by the nature of the insulating substrate. This substrate can be a usual electrostatic duplicating master or an electrophotographic element. The surface of the master or element may be smooth or rough. Thus, with smooth, organic photoconductive layers, such as, for example, of polyvinylcarbazole or selenium, the transfer yield obtained is equal to the transfer yield which is obtained with rough layers, such as, for example, layers which mainly comprise a dispersion of zinc oxide in a binder. When using a substrate having photoconductive layers with a positive charge image, for instance, as is typical with selenium layers, it is necessary to first apply a negative and then a positive charge at the transfer station, whereas with negatively chargeable layers the reverse is the case.

The support of the photoconductive layer may comprise an electrically conductive drum or electrically conductive foil. If desired, a blocking layer or an adhesive layer can be applied between the conductive and the photoconductive layer.

The magnetizable developing powder generally comprises resin particles with a magnetizable core or resin particles in which finely divided magnetizable material is embedded. The finely divided magnetizable material can be fully enveloped by the resin particles. Also, powder particles which have a part of the magnetizable material on their surface can be used, provided that the magnetizable material does not form closed circuits of conductive material around the surface. The quantity of magnetizable material in the resin particle is not critical. For example 20 to 70 parts by weight of magnetizable material per 100 parts by weight of resin are very suitable. The resin can be chosen from the insulating resins which are typical for developing powders. Epoxy resins, acryl resins, polystyrene and other vinylpolymers are exemplary. Other exemplary resins for the developing powder are those described in British patent specification No. 1,481,332. In addition to the two mentioned main components, the developer powder may contain small quantities of typical auxiliary components, such as dyes, charge-controlling agents and flow enhancers. Also, small quantities of conductive material, such as carbon, may be present, provided that the quantity is so low that the specific resistance of the developing powder remains greater than $10^{13}$ Ohm.cm.

The drawings represent the results obtained in examples using the prior art process and using the process of the invention and illustrate, in graphical form, the relationship between transfer yield and transfer or pretransfer current. The transfer yield is plotted vertically on the graph in percent and transfer or pretransfer current is plotted horizontally in $\mu$A.

The invention and its objects and advantages will be further apparent from the following examples of embodiments thereof.

EXAMPLE I

A photoconductive element having a width of 21 cm. was tightened on a metal drum with a diameter of 15 cm. and a length of 23 cm. The photoconductive element support comprised a polyester foil on both sides of which a layer of aluminum had been evaporated. The photoconductive surface comprised a charge-generating layer with a charge-transporting layer applied on top of it. The charge-generating layer had a thickness of 3 $\mu$m and comprised a dispersion of fenelac blue in a mixture of polyvinylcarbazole and trinitrofluorenone. The weight-proportion of polyvinylcarbazole:trinitrofluorenone:fenelac blue was 10:1:5.5. The charge-transporting layer was comprised of polyvinylcarbazole and had a thickness of 20 $\mu$m.

The drum was mounted in an electrophotographic copying apparatus and the conductive layers were grounded via the drum. At a rotation speed of 5 meters per minute, the photoconductive surface was repeatedly subjected to the following series of processing steps:

(a) negative charging up to the maximum potential;
(b) imagewise exposure;
(c) magnetic brush development with a one-component magnetizable developing powder comprised of round particles with an average diameter of 15 $\mu$m and formed of a dispersion of magnetite in an epoxy resin (available commercially as Epikote 1004 from Shell Company) in the weight proportion 1:1. No means for charging the developer powder were used. To the extent that the developer powder carried some charge, this was caused by slight triboelectric charging due to its ambiance or the influence generated by the charge image;
(d) homogeneous exposure with a tube lamp for removing rest charges on the non-developed parts of the photoconductive element;
(e) transfer of the developed image to a sheet of paper by feeding the sheet, having a width of 21 cm., between the rotating photoconductive surface and two rolls installed close to this surface. The rolls had a diameter of 19 mm. and consisted of a metal core which was covered with a 3 mm. thick layer of a conductive rubber having a specific resistance of $4\times10^8$ Ohm.cm. The center distance between the rolls was 2 cm;
(f) removal of the paper from the photoconductive surface, followed by measurement of the quantity of developing powder on a small black square of the transferred image and on the corresponding small square on the photoconductive surface.

Before repeating the series of processing steps described above the photoconductive surface was cleaned with the aid of a magnetic roll.

Two series of tests were carried out as described below.

Figure 1:
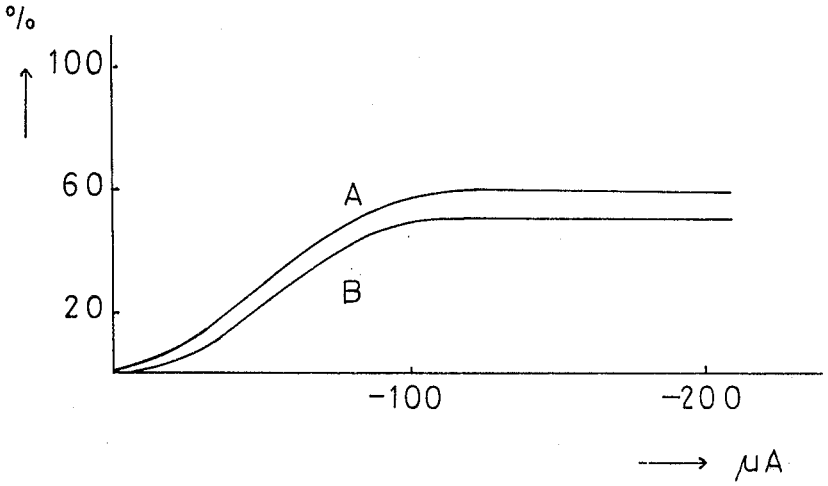
FIG. 1 represents the measurement of transfer yield at various transfer currents through the second roll in Example 1, a single charge application as in the prior art.

In the first series of tests, the first of the rolls mentioned under (e) was not connected to a voltage source and the second roll was connected to an adjustable voltage source with the negative potential on the roll. The transfer yield was measured at various currents through the second roll (transfer currents). This measurement is represented in FIG. 1 where the transfer yield, in percent, is plotted on the vertical axis and the transfer current, in μA, is plotted on the horizontal axis. The values on the curve A are for receiving paper with a surface resistance of $10^{11}$ Ohm per square and the values on curve B are for paper with a surface resistance of $5\times10^9$ Ohm per square.

Figure 2:
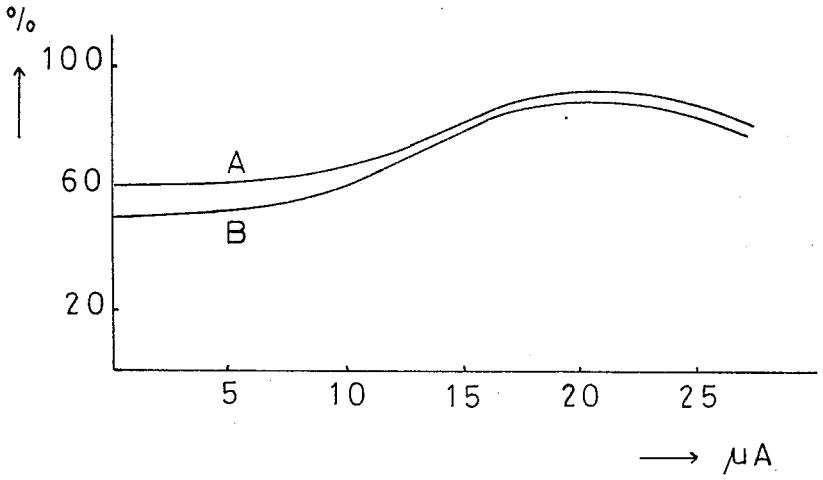
FIG. 2 represents the measurement of transfer yields at various pre-transfer currents through the first roll in Example 1 according to an embodiment of this invention.

In the second series of tests the transfer current on the second roll was kept constant at 100 μA. The first roll was connected to an adjustable voltage source with the positive potential on the roll. The transfer yield was measured at various currents on the first roll (pre-transfer currents). The results are represented in FIG. 2. The transfer yield, in percent, is plotted on the vertical axis and the pre-transfer current, in μA, is plotted on the horizontal axis. In FIG. 2, curves A and B have the same significance as in FIG. 1.

FIGS. 1 and 2 show that the transfer yield can increase from a level of 50–60 percent to 95 percent by the application of a pre-transfer current. FIG. 2 shows that the transfer yield is optimum at pre-transfer currents between 15 and 25 μA. However, in the above tests, the pre-transfer current is preferably not adjusted to a value greater than 22 μA, because at higher values the image-sharpness decreases slightly. At a transfer width of 21 cm. and a rotation speed of 5 meters per minute, pre-transfer currents between 15 and 22 μA correspond to charges between about 0.1 and 0.15 μC per $cm.^2$ of paper surface. The optimum transfer current is 100 μA, corresponding to a charge of 0.6 $\mu C/cm^2$. Higher values yield a similar result.

EXAMPLE II

Figure 3:
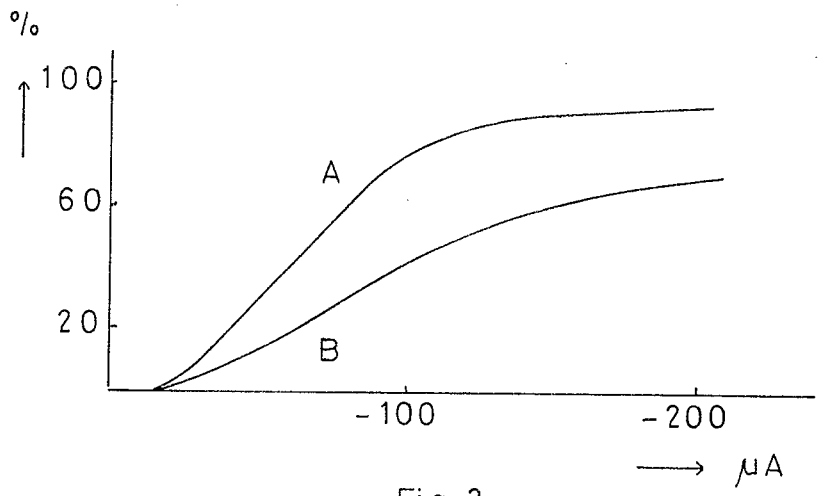
FIG. 3 represents the measurement of transfer yield at various transfer currents through the second roll in Example II, a single charge application as in the prior art.
Figure 4:
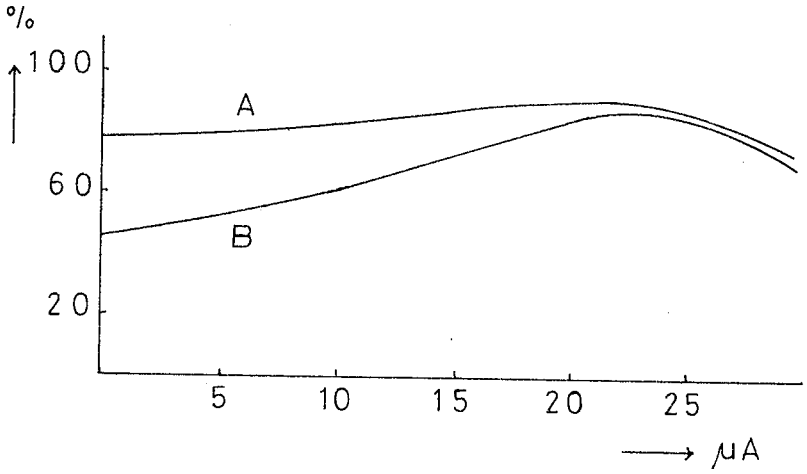
FIG. 4 represents the measurement of transfer yield at various pre-transfer currents through the first roll in Example II according to an embodiment of this invention.

The tests described in EXAMPLE 1 were repeated in the same manner but with the photoconductive element replaced by a photoconductive element having the same support as in EXAMPLE I and a photoconductive layer having a thickness of 13 μm and comprising a dispersion of zinc oxide in a styrene-acrylate copolymer (available commercially as E 312 from the De Soto Company). The weight-proportion of zinc oxide:-copolymer was 4:1. The zinc oxide was sensitized with bromophenol blue. The results are represented in FIGS. 3 and 4 of which the coordinates are respectively the same as those of FIGS. 1 and 2 and A and B respectively relate to papers having a surface resistance of $10^{11}$ and $5\times10^9$ Ohm per square, as in FIGS. 1 and 2.

I claim:

1. In a process for transferring a magnetizable developing powder in electrostatic image development, wherein the powder has a specific resistance greater than $10^{13}$ Ohm.cm. and has been applied imagewise, corresponding to a charge image, on an insulating substrate, including the steps of bringing the substrate with the powder image in contact with a receiving material to which the powder is to be transferred, applying a charge to the free side of the receiving material, transferring the powder and subsequently separating the receiving material from the substrate, the improvement therein comprising applying two separate charges to the free side of the receiving material during the period of contact with the substrate, the first of such charges having a polarity opposite to that of the charge image and the second of such charges having the same polarity as that of the charge image and being greater than the first.

2. The improved process as claimed in claim 1 wherein the first charge is between 0.08 to 0.17 μC per $cm^2$. and the second charge is at least 0.5 μC per $cm^2$.

3. The improved process as claimed in claim 1 wherein the first charge in between 0.1 and 0.15 μC per $cm^2$. and the second charge is between 0.6 and 1.6 μC per $cm^2$.

4. The improved process as claimed in claims 2 or 3 wherein the second charge is applied to the receiving material within 0.5 second after the first charge was applied.

5. The improved process as claimed in claims 2, 3 or 4 wherein the receiving material is ordinary paper having a surface resistance between $5\times10^9$ to $10^{11}$ Ohm per square.

6. A process for transferring a magnetizable developing powder which has a specific resistance greater than $10^{13}$ Ohm.cm. and has been applied imagewise, corresponding to a charge image, on an insulating substrate, comprising bringing the substrate with the powder image in contact with a receiving material, applying a pretransfer charge of 0.08 to 0.17 μC per $cm^2$. with a polarity opposite to that of the charge image during the contact to the free side of the receiving material, then applying a transfer charge of at least 0.5 μC per $cm^2$. with the same polarity as that of the charge image during the contact to the free side of the receiving material and within 0.5 second of the first charge, transferring the powder and subsequently separating the receiving material from the substrate.

7. A process as claimed in claim 6 wherein a powder transfer yield of approximately 85 percent is obtained.

* * * * *